United States Patent [19]

Moss

[11] 4,236,543

[45] Dec. 2, 1980

[54] PORTABLE TENT

[76] Inventor: Charles W. Moss, Mill St., Rockport, Me. 04806

[21] Appl. No.: 52,441

[22] Filed: Jun. 26, 1979

[51] Int. Cl.[3] ..... A45F 1/16

[52] U.S. Cl. ..... 135/3 R

[58] Field of Search ..... 135/1 R, 3 R, 3 A, 3 E, 135/4 R, 7.1

[56] References Cited

U.S. PATENT DOCUMENTS

| | | | |
|---|---|---|---|
| 2,543,684 | 2/1951 | Blanchard | 135/3 E |
| 2,976,876 | 3/1961 | Lönnqvist | 135/3 R |
| 3,255,467 | 6/1966 | Kowalski | 135/3 R X |
| 3,534,750 | 10/1970 | Kolozsvary | 135/1 R |
| 4,078,572 | 3/1978 | Moss | 135/1 R |

FOREIGN PATENT DOCUMENTS

| | | | |
|---|---|---|---|
| 681598 | 3/1964 | Canada | 135/3 R |
| 7708497 | 2/1978 | Netherlands | 135/3 E |

*Primary Examiner*—J. Karl Bell

[57] ABSTRACT

A small, lightweight tent having enhanced comfort and stability includes a flexible covering having two generally similar side walls. Two resiliently flexible pole members are held flexed by the side walls so as to hold the side walls tense and thereby shape and support the tent. In this way, the tent is made freestanding. The tent further includes a flared top portion closed only by a net material to not only enhance ventilation of the tent, but also permit viewing of the sky.

13 Claims, 6 Drawing Figures

PORTABLE TENT

The present invention relates to portable structures or tents, and more particularly, to small, lightweight tents which offer both comfort and stability and yet can be erected easily.

Tents suitable for such purposes as backpacking are designed to be lightweight and easily compacted for easy transport and thus, when erected, often lack adequate room and ventilation to assure desired comfort. Also, such tents typically include a flexible covering supported by poles, and extensive staking and guying are required to maintain the shape and stability of the tent. Such tents are thus difficult and time consuming to erect, and are often unsuitable for exceptionally rocky or sandy terrain.

It is therefore, an object of the present invention to provide a portable tent which owes its shape and stability primarily to the interaction of a flexible covering and resilient poles.

A further object of the present invention is to provide a compact, portable tent which may be ventilated adequately even in foul weather, and has a large amount of inside space when erected.

An additional object of the present invention is to provide a free-standing tent.

Another object of the present invention is to provide a tent which sheds wind loads easily.

According to the present invention, a portable shelter includes a flexible covering having opposing side walls held tense to provide the shape of the shelter by two resiliently flexible pole members held in a flexed condition primarily by peripheral portions of the side walls. The peripheral portions of the side walls are preferably formed by tunnels having diameters larger than that of the pole members, and each pole member has the end portions thereof held respectively by front and rear peripheral portions of the same side wall to hold the pole member in an inverted generally U-shape and the central portion of each pole member is held by the upper peripheral portion of the other side wall to hold the pole member in a bowed shape. In the preferred embodiment, the upper peripheral portions of each side wall are formed by tunnels of netting material. The flexible covering further includes a top wall interconnecting the upper portions of the side walls. In this way, the side walls are continually tensed both horizontally and vertically by the resilient pole members held in a flexed state by peripheral portions of the side walls.

Preferably, the top wall is constituted by netting and the side walls each have a vertical contour which bows outwardly at the lower portions thereof and turns upwardly at its upper portion to form a flared portion interconnected by the top wall netting. By these means, the room within the shelter is maximized and the shelter may be readily ventilated by air currents flowing through a door opening and upwardly through the netting of the top wall. Also, the upper portions of the vertical contour of the side walls may bow out outwardly in the horizontal direction to enable the shelter to shed wind loads easily.

The shelter may also include a water resistant fly fitting over the covering for use in foul weather. The fly is spaced from the covering by the tunnels forming the peripheral portions of the side walls so that air currents flowing from the netting of the top wall can flow through the net tunnels of the upper peripheral portions and out from under the fly. In this way, the shelter may be ventilated even when the fly is being used. Further, a third resiliently flexible pole member may be provided for the fly. This third pole member is held in flexed condition by a front portion of the fly into an inverted generally U-shape to urge the fly away from the covering.

Preferably, the pole members are each formed by a plurality of segments detachably interfitted by, for example, an insert extending from an end portion of one segment and adapted to fit within an end portion of an adjacent segment. The inserts and segments may each be tubular and the respective segments of each pole member may be interconnected by an elastic cord running therethrough. In this way, the segments of the respective pole members will be maintained together during storage or transport, and the elastic cord will serve to hold the segments together during assembly and use of the tent.

Other objects, features and advantages of the present invention will become apparent from the following detailed description and accompanying drawing, in which:

FIG. 1 is a perspective view of the front of an illustrative embodiment of the present invention;

FIG. 1*a* is an enlarged view of a corner portion of the tent of FIG. 1;

Figure 1:
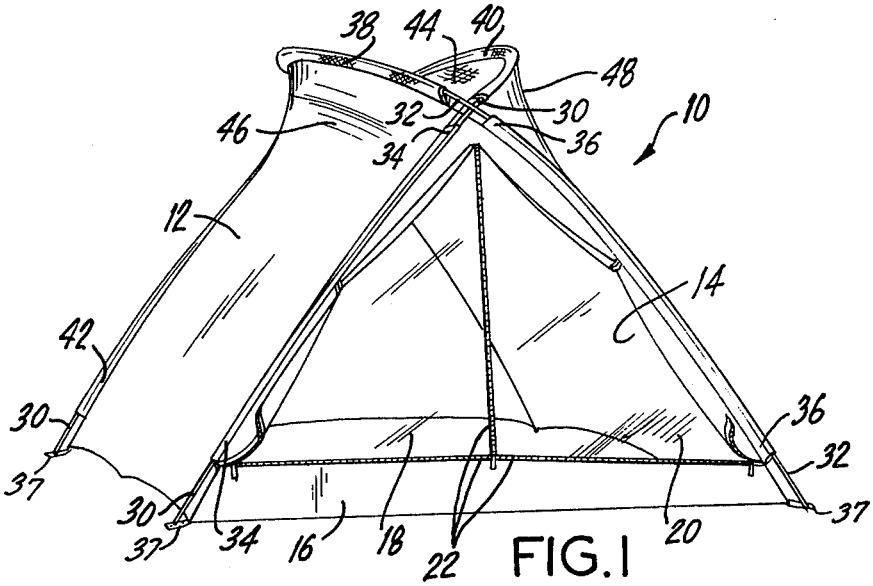
Figure 1A:
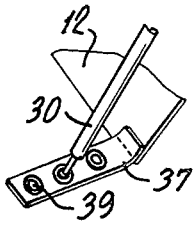

FIG. 1 illustrates a tent 10 roomy enough for two or three persons and easily protable rendering it ideal for backpacking and the like. The tent 10 includes a flexible fabric covering having two side walls 12 and 14 extending between a back wall and a front wall 16 having a door opening. The door opening preferably includes separable flaps 18 and 20 of netting material joined by a conventional inverted "T" zipper 22 and outer door flaps shown tied back. The outer door flaps also may be joined by a conventional inverted "T" zipper to overlie the separable flaps 18 and 20.

The tent 10 is free-standing, i.e., it does not require any staking or guy lines to hold its shape or to maintain stability. More particularly, the opposing side walls 12 and 14 are held tense against the shape of their cut by two resiliently flexible pole members 30 and 32 held in a flexed condition by peripheral portions of the side walls.

The respective peripheral portions of the side walls are preferably formed by tunnels affixed along edge portions of the side walls. As shown in FIG. 1 the side walls 12 and 14 have respective front tunnels 34 and 36 extending along the front edges thereof and respective upper tunnels 38 and 40 extending along the top edges thereof. The upper tunnels 38 and 40 are preferably formed from a netting material for purposes to be described more fully below. Similarly, the back edges of the side walls have respective rear tunnels extending respectively therealong. The rear tunnels are similar to the front tunnels and one of which, rear tunnel 42 of side wall 12, is visible in FIG. 1.

The pole members 30 and 32 are initially straight, but they are run through respective tunnels and resiliently flexed and held into a compound or double curve configuration tensing the side walls both vertically and horizontally.

Figure 2:
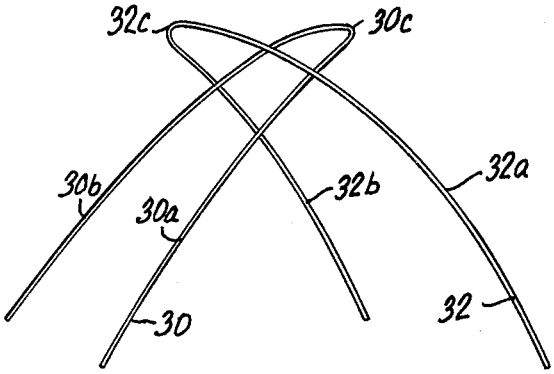
FIG. 2 is a schematic illustration of the flexed condition of the pole members of FIG. 1.

As shown in FIG. 1 and schematically in FIG. 2, the end portions 30*a* and 30*b* of pole member 30 are held respectively by the front tunnel 34 and the rear tunnel 42 of side wall 12, and the end portions 32*a* and 32*b* of pole member 32 are held by the front and rear tunnels, respectively, of side walls 14. In this way, each of the pole members is held in a first curve forming an inverted "U" and serves to tense the respective side walls continually in the horizontal direction therealong.

The pole members include curved central portions, 30*c* and 32*c* respectively, and are made to cross one another as shown in the figures. These curved central portions are held by respective upper portions 38 and 40, but since the pole members cross, curved portion 30*c* is held by upper tunnel 40 of side wall 14 and curved portion 32*c* is held by upper tunnel 38 of side wall 12. The pole members are flexed between their bases and the respective upper tunnels so as to bow outwardly and thereby form a second curve serving to tense the respective side walls continually in their vertical direction.

The bases of the pole members may be held in their respective positions by the four corners of the tent adjacent to the bases of the pole members being staked or, preferably, the four corners of the tent may be provided with integral holders receiving the bases of the pole members. In the illustrated embodiment, these holders are constituted by tabs 37 each having one or more grommets 39 receiving reduced diameter base portions of the poles. Further, the fabric covering of the tent includes a top wall 44 interconnecting the upper portion of the side walls 12 and 14. The pole members can thus be maintained in their compound curved configuration by the fabric covering of the tent without the need for staking or use of guy lines.

Figure 3:
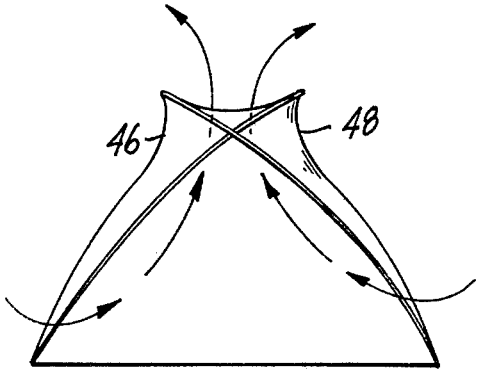
FIG. 3 is a schematic illustration of the air flow through the tent of FIG. 1.

In the preferred embodiment of the present invention, the top wall 44 is formed of a netting material which not only aids in ventilation of the tent, but also allows for viewing of the day or evening sky to provide a truly outdoor experience. Further, the side walls are cut so that the vertical contour thereof not only bows outwardly at its lower portion due to the curve of the pole members, but also turns upwardly at upper portions 46 and 48 to a flared top portion interconnected by the top wall netting. Consequently, there is considerable room within the tent interior per unit of floor space and, as shown schematically in FIG. 3, the open top portion of the tent provides a funneling effect resulting in cool air being drawn in through the door opening and warmer, more moist air to flow out through the top wall netting. This roomy interior and superior ventilation provide extraordinary comfort for a small, lightweight tent. Also, as can be seen from FIG. 1, the upper portions 46 and 48 bow outwardly in the horizontal direction to provide a rounded surface which easily sheds wind loads which may otherwise unduly stress the tent.

Figure 4:
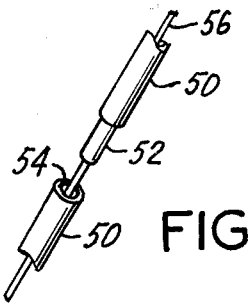
FIG. 4 is a perspective view, partly broken away, of a portion of a pole member of FIG. 1.
Figure 6:
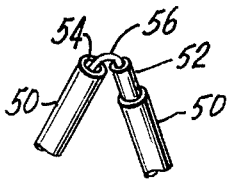
FIG. 6 is similar to FIG. 4 and shows the flexible nature of the cord 56.

FIG. 4 illustrates a preferred construction of the pole members. The pole members desirably should be able to be broken down for transport and storage and yet be easily assembled for quick erection in the field. To this end, the pole members are each formed by a plurality of respective segments 50, each preferably made from a resiliently flexible aluminum alloy. The segments 50 are detachably interfitted by suitable means such as by insert portion 52 extending from one end of respective segments and of a diameter to be received snugly within an open end portion 54 of an adjacent segment. Also, the respective segments of each pole member may be strung together by an elastic cord 56 running therethrough. In this way, the segments of the respective pole members will be maintained together during transport and storage. Further, when the segments are assembled, the elastic cord will be tensed so as to hold the segments together during assembly and use of the tent.

Figure 5:
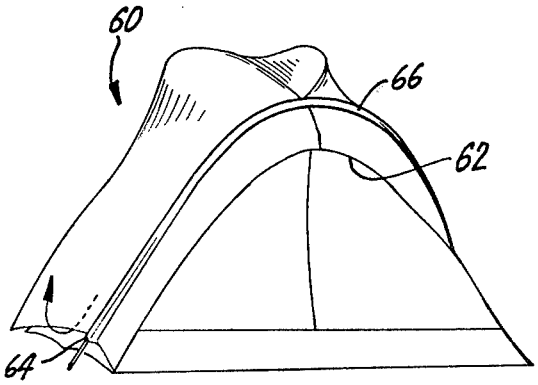
FIG. 5 is a perspective view of the tent of FIG. 1 with a fly fitted thereover.

The shelter may also include a water resistant fly 60 fitting over the covering for use in foul weather. As shown in FIG. 5, the fly includes an overhang 62 over the door opening and conforms to the tent shape. The corners of the fly 60 may be attached to the four bases of the pole members, or to the corners of the covering, by suitable means and the fly has a pole member 64 fitted and held flexed within a fabric tunnel 66. The pole member 64 is of a construction similar to that for the pole members 30 and 32 and serves to shape the fly as well as space it from the covering.

The fly is also spaced from the covering by the tunnels holding the pole members 30 and 32. Each of these tunnels is provided with a diameter quite larger than that of the pole members. Consequently, the net tunnels of the upper peripheral portions 38 and 39 form air permeable flange portions between the pole members and the main body of the covering. The flange portions preferably have a width of 1 inch to 6 inches and, in this way, air currents flowing from the top wall 44 of the covering can flow between the fly and the covering, through the net tunnels and thence from under the fly, as illustrated in FIG. 5. Thus, the tent can be ventilated even in foul weather.

While the present invention has been described with reference to a particular embodiment thereof, it is to be understood, that the invention is intended to be defined and limited by the appended claims.

What is claimed is:

1. A portable shelter comprising a flexible covering having opposing side walls held tense to provide the shape of the shelter by two resiliently flexible pole members held in a flexed condition by peripheral portions of said side walls, each said pole member having the end portions thereof held respectively by front and rear peripheral portions of the same side wall to hold the pole member in an inverted generally U-shape tensing said side walls horizontally and the central portion thereof held by the upper peripheral portion of the other side wall to hold the pole member in a bowed shape tensing said other side wall vertically, said fabric covering further including a top wall interconnecting the upper portions of said side walls.

2. A shelter according to claim 1, said top wall being constituted by netting, said side walls each having a vertical contour which bows outwardly at the lower portions thereof and turns upwardly at its upper portions to form a flared portion, said shelter further including a door opening whereby said shelter may be readily ventilated by air currents flowing through said door opening and upwardly through the netting of said top wall.

3. A shelter according to claim 2, the upper portions of said vertical contour bowing outwardly in the horizontal direction.

4. A shelter according to claim 2, the peripheral portions of said side walls being formed by tunnels having diameters larger than that of said pole members, said upper peripheral portions being formed by tunnels of netting whereby said tunnels of netting will provide air permeable flange portions between said pole members and the main body of said covering.

5. A shelter according to claim 4, said shelter further including a water resistant fly fitting over said covering and spaced therefrom by said flange portions whereby the air currents flowing from the netting of said top wall can flow through said flange portions and out from under said fly.

6. A shelter according to claim 5, comprising a third resiliently flexible pole member held in a flexed condition by a front portion of said fly, said third pole member being held in an inverted generally U-shape to urge said fly away from said covering.

7. A shelter according to claim 1, said side walls each having means at the respective lower corners thereof for holding the respective base portions of said pole members.

8. A shelter according to claim 7, said base portions having a reduced diameter and said holding means being constituted by tabs having at least one grommet therein for receiving said base portions.

9. A shelter according to either of claims 1, 2 or 6, wherein said pole members are each formed by a plurality of segments detachably interfitted.

10. A shelter according to claim 9, each of said segments being tubular with an insert element extending from an end portion thereof and adapted to fit within an end portion of the adjacent segment.

11. A shelter according to claim 10, said segments being formed from an aluminum alloy.

12. A shelter according to claim 10, said inserts being tubular, the respective segments of each pole member be interconnected by an elastic cord running therethrough.

13. A shelter according to claim 12, said segments being formed from an aluminum alloy.

* * * * *